US007707649B2

(12) United States Patent
Dancyger

(10) Patent No.: US 7,707,649 B2
(45) **Date of Patent: *May 4, 2010**

(54) KNEE PAD

(75) Inventor: Michael Dancyger, Los Angeles, CA (US)

(73) Assignee: Custom LeatherCraft Mfg. Co., Inc., South Gate, CA (US)

( * ) Notice: Subject to any disclaimer, the term of this patent is extended or adjusted under 35 U.S.C. 154(b) by 353 days.

This patent is subject to a terminal disclaimer.

(21) Appl. No.: 11/509,199

(22) Filed: Aug. 23, 2006

(65) Prior Publication Data

US 2007/0192922 A1 Aug. 23, 2007

Related U.S. Application Data

(60) Provisional application No. 60/765,282, filed on Feb. 3, 2006.

(51) Int. Cl.
*A41D 13/00* (2006.01)

(52) U.S. Cl. ..... 2/24

(58) Field of Classification Search ..... 2/455, 2/16.22, 24, 62, 911; 128/881, 882; 602/23, 602/26, 62–63

See application file for complete search history.

(56) References Cited

U.S. PATENT DOCUMENTS

| | | | | |
|---|---|---|---|---|
| 3,786,804 | A * | 1/1974 | Lewis | 602/16 |
| 5,024,216 | A * | 6/1991 | Shiono | 602/26 |
| 5,915,529 | A * | 6/1999 | Popowski | 2/16 |
| 6,795,974 | B1 * | 9/2004 | Howell | 2/22 |

* cited by examiner

*Primary Examiner*—Tejash Patel

(57) ABSTRACT

A knee pad for cushioning a human knee. The knee pad includes a cushion section having varied consistencies. The knee pad is held on the knee by two fastening straps. Each fastening strap is attached to the cushion section with buckles or similar fastening devices. A lower fastening strap has at least two closure devices, a first being a hook and eye fastening system and a second being a buckle fastening system.

2 Claims, 4 Drawing Sheets

KNEE PAD

CROSS REFERENCE TO RELATED APPLICATIONS

The present invention is related to Provisional Application Ser. No. 60/765,282, filed on Feb. 3, 2006 and entitled "Knee Pad", the entire disclosure of which is herein incorporated by reference.

BACKGROUND OF THE INVENTION

The present invention relates generally to knee pads and more particularly to a knee pad having a secure fastening system.

Knee pads are well known for protecting the knees while working or while playing sports. One common type of knee pad for construction work includes a cushion section which fits over the knee. The knee pad allows the user to move around easily on his/her knees by swiveling and sliding on the knees while providing protection against injury. The buckles on the straps and other fastening devices are used to fasten the knee pad around the knee.

U.S. Pat. No. 1,792,048 to Swenson discloses a knee protector having two bands of elastic material stitched to a rubber cushioning pad. The length of each band is adjustable by a three-bar fitting.

U.S. Pat. No. 4,872,448 to Johnston, Jr. discloses a knee brace that functions to support and stabilize the patella of the knee. An inflatable U-shaped air cell extends to either side of the patella. The air cell may be inflated by mouth pressure through a tube and valve. The straps are secured around the leg and the air cell by hook and loop fasteners. A backing member of open cell polyurethane foam is located between the knee and the air cell, and has a perforation to permit the crown of the patella to extend through.

U.S. Pat. No. 5,383,843 to Watson et al. discloses an air pressure knee brace apparatus having valve means to allow the user to adjust the desired amount of support pressure. The pneumatic chamber has an aperture located directly over the kneecap. The adjustment straps include buckles to control the tension around the knee. The front of the apparatus is composed of neoprene, while the pneumatic chamber is made of latex rubber.

U.S. Pat. No. 5,500,955 to Gongea discloses a knee pad for athletes which includes a stretchable elastic region connecting the various cushion regions. The fastening strips also attach to the elastic region.

U.S. Pat. No. 5,524,292 to Hargens discloses a knee pad unit having a hard outer plastic shell. Inflatable pneumatic tubes are attached to the shell by VELCRO® fasteners. The tubes are inflated by a hand held air pump.

U.S. Pat. No. 6,070,267 to McKewin discloses a knee pad holder including simple loops or keepers secured to the trousers leg. The loops are provided for use only with an upper strap to hold the knee pad against downward movement.

There exists a continuing need in the art for a knee pad that provides protection to the knee while allowing for mobility and flexibility. There is also a need for a knee pad having a double closing system that remains secure during repeated kneeling and standing motions and while walking on the knees. There is a further need for a knee pad provides a tighter fit around the knee.

SUMMARY OF THE INVENTION

The present invention provides a knee pad for cushioning a human knee. The knee pad includes a cushion section having varied consistencies. The knee pad is held on the knee by two fastening straps. Each fastening strap is attached to the cushion section with buckles or similar fastening devices. A lower fastening strap has at least two closure devices, a first being a hook and eye fastening system and a second being a buckle fastening system.

In accordance with an aspect of the invention, a knee pad includes a cushion section; an upper fastening strap including a first buckle fastening system; and a lower fastening strap including a hook and eye fastening system and a second buckle fastening system.

In accordance with another aspect of the invention, a knee pad includes a cushion section; an upper fastening strap including a first buckle fastening system, the first buckle fastening system having a first female buckle component attached to a cushion section upper portion first border and a first strap attached to a cushion section upper portion second border, the first strap adjustably receivable in a first male buckle component; and a lower fastening strap including a hook and eye fastening system and a second buckle fastening system, the hook and eye fastening system having a first component formed on an outside surface and proximate an end of a lower fastening strap second segment and a second component formed on an inside surface and proximate an end of a lower fastening strap first segment, the second buckle fastening system having a second female buckle component attached on the outside surface of the lower fastening strap second segment in spaced relationship to the hook and eye fastening system first component, a second strap attached to a cushion section lower portion first border and receivable through a plurality of loops formed on an outside surface of the lower fastening strap first segment, and a second male buckle component, the strap adjustably receivable in the male buckle component.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of design and to the arrangement of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and compositions for carrying out the several purposes of the present invention. It is important, therefore, that the claims be regarded as including such equivalent methods and systems insofar as they do not depart from the spirit and scope of the present invention.

BRIEF DESCRIPTION OF THE DRAWINGS

The present disclosure may be better understood and its numerous features and advantages made apparent to those skilled in the art by referencing the accompanying drawings.

DETAILED DESCRIPTION OF THE INVENTION

Figure 1:
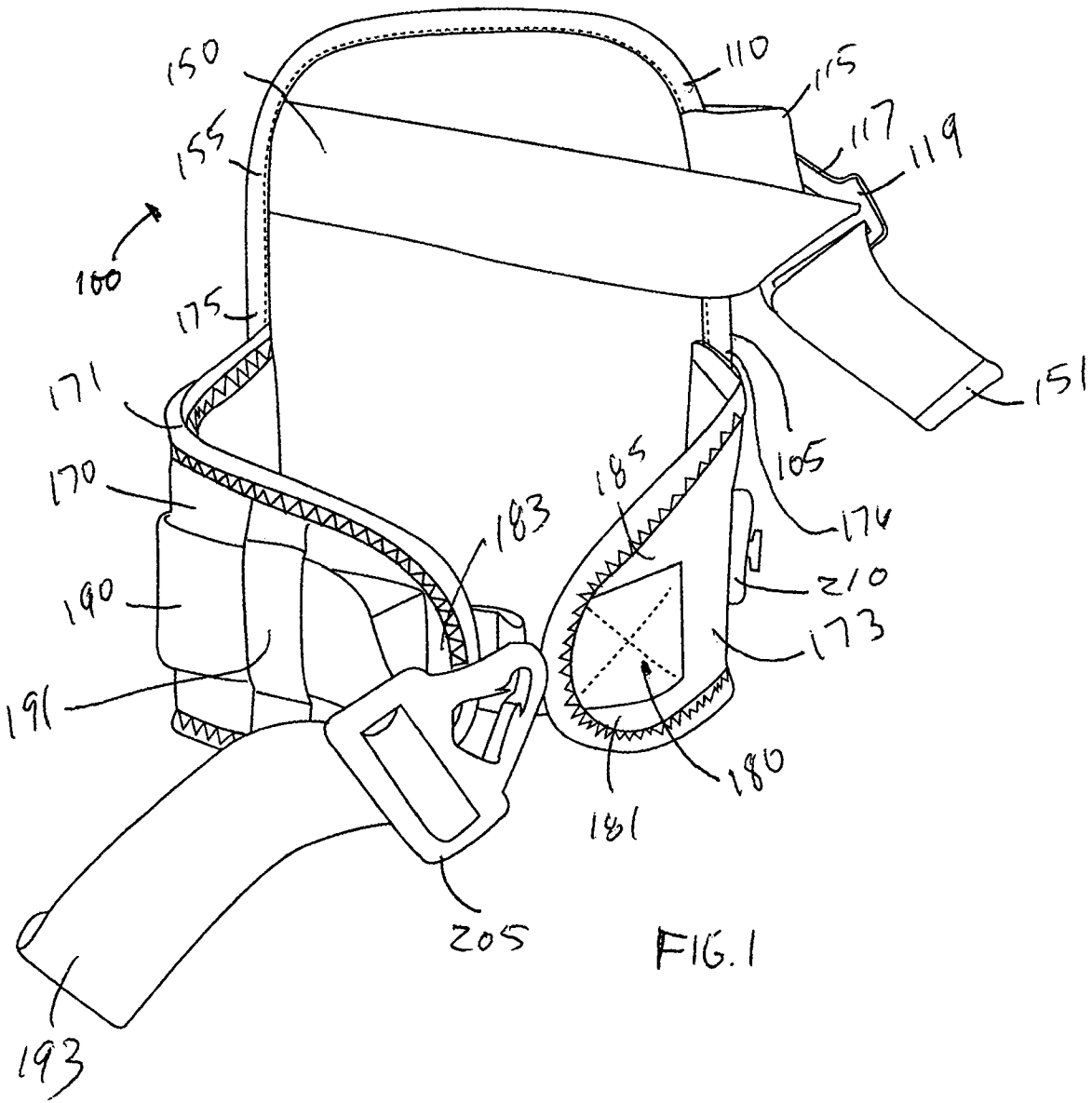
FIG. 1 is a rear elevation view of the knee pad showing the upper fastening strap in an attached position in accordance with the invention.
Figure 2:
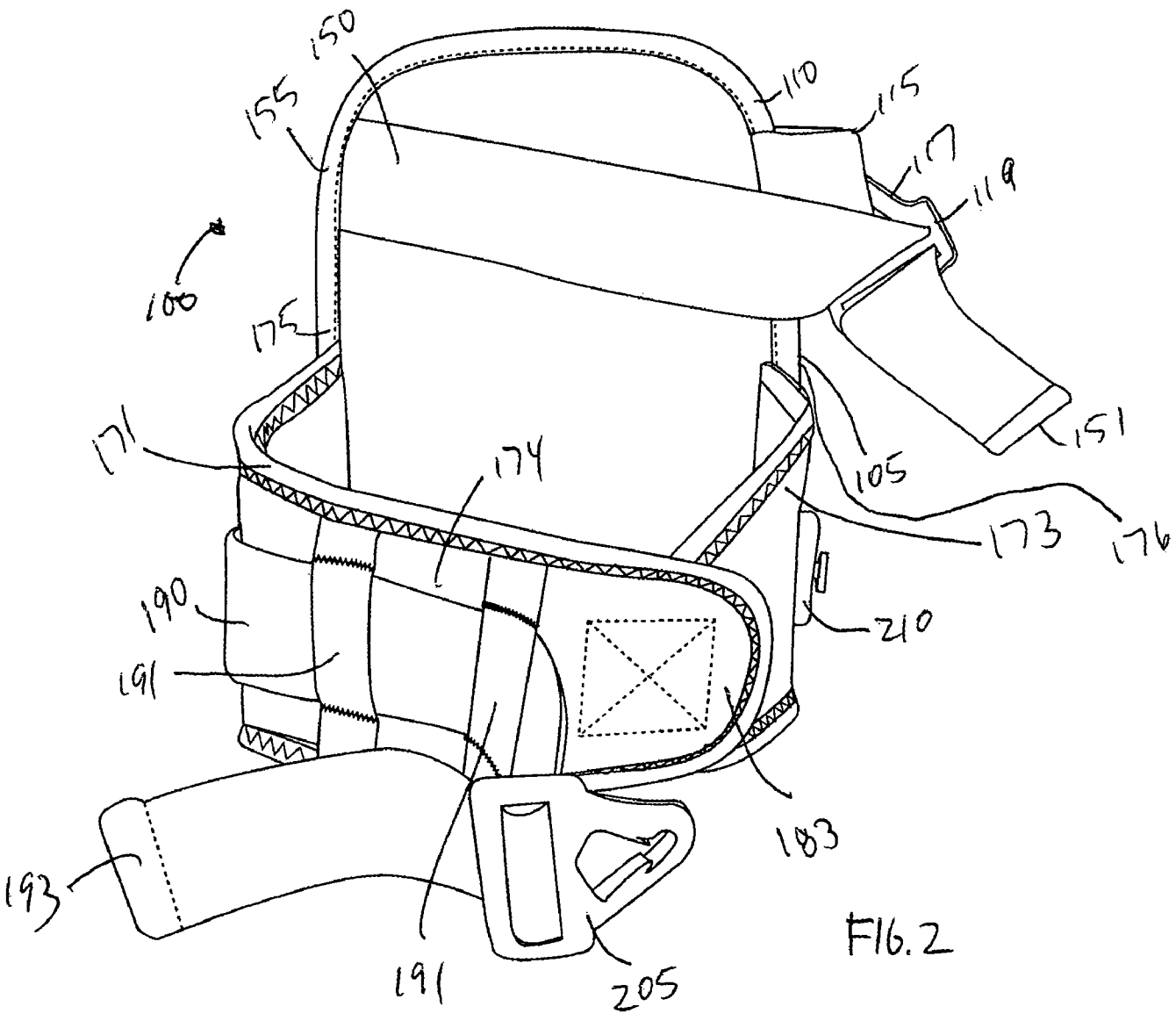
FIG. 2 is a rear elevation view of the knee pad showing the upper fastening strap and the first closure device of the lower fastening strap in attached positions in accordance with the invention.
Figure 3:
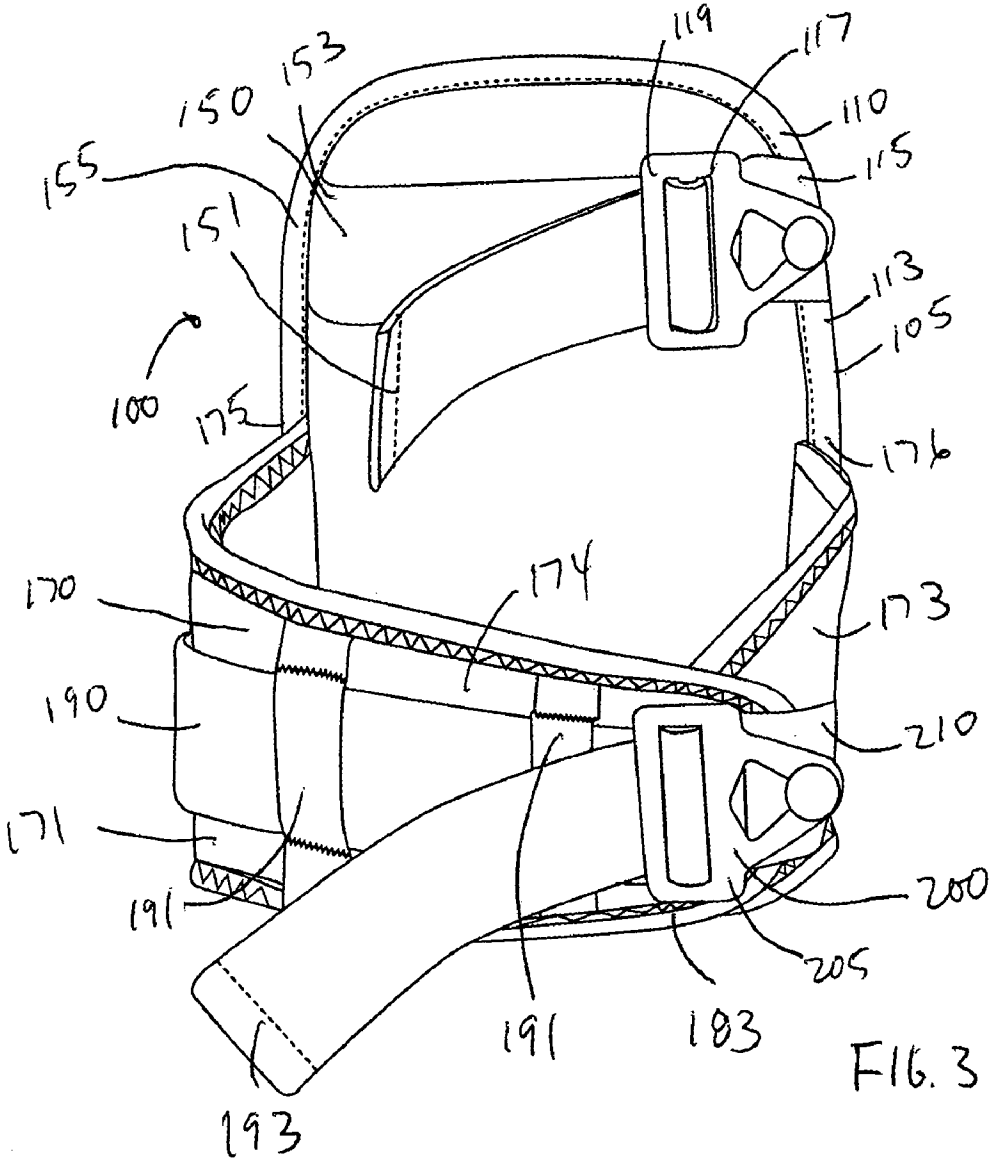
FIG. 3 is a rear elevation view of the knee pad showing the upper fastening strap and the second closure device of the lower fastening strap in attached positions in accordance with the invention.
Figure 4:
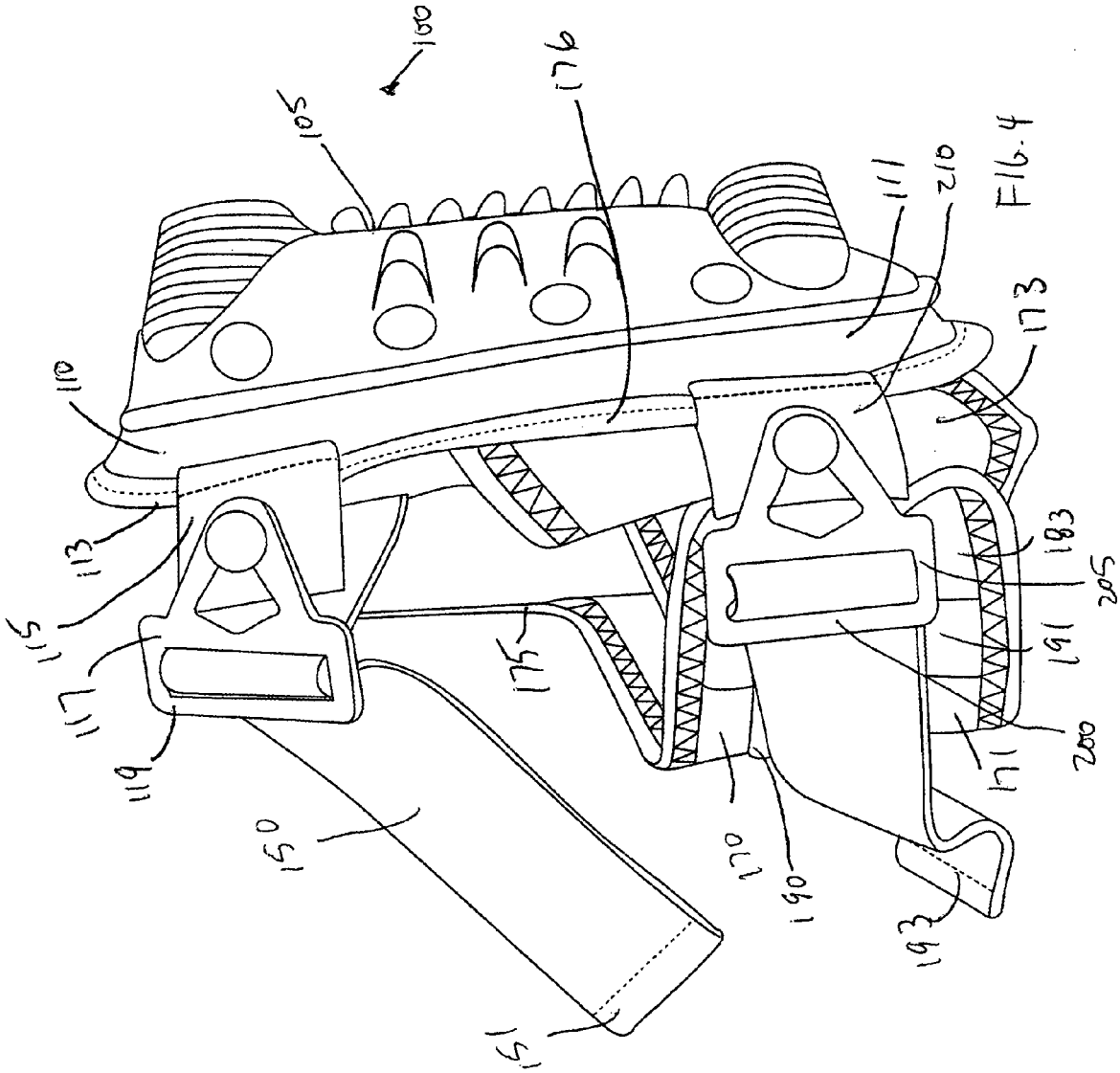
FIG. 4 is a side elevation view of the knee pad of FIG. 3 in accordance with the invention.

With reference to FIG. 1 through FIG. 4, a knee pad generally designated 100 includes a cushion or pad section 105, an upper fastening strap 150 and a lower fastening strap 170. The cushion or pad section 105 may be formed of various materials to provide padding to the knee as is well known in the art. Upper fastening strap 150 may be formed of any flexible and sturdy material including cotton, nylon and soft leather. Lower fastening strap 170 is generally thicker than the upper fastening strap 150 and may be formed of any flexible and sturdy material including cotton, nylon and soft leather.

Cushion or pad section 105 includes an upper portion 110 having sewn proximate a border 113 thereof a female component 115 of a first buckle fastening system 117. First buckle fastening system 117 further includes a male component 119 through which a first end 151 of the upper fastening strap 150 is adjustably received. A second end 153 of the upper fastening strap 150 is sewn proximate a border 155 of the upper portion 110.

Cushion or pad section 105 further includes a lower portion 111 having sewn proximate a border 175 thereof a first segment 171 of the lower fastening strap 170. A second segment 173 of the lower fastening strap 170 is sewn proximate a border 176 of the lower portion 111.

Second segment 173 of the lower fastening strap 170 includes a first component 180 of a hook and eye fastening system formed on an outside surface 185 and at an end 181 thereof as best seen in FIG. 1. A second component (not shown) of the hook and eye fastening system is formed on an inside surface of the first segment 171 of the lower fastening strap 170 at an end 183 thereof. First component 180 and the second component of the hook and eye fastening system provide a first closure device to the lower fastening strap 170.

A second closure device is provided to the lower fastening strap 170 by means of a second buckle fastening system 200. A flexible and sturdy strap 190 is sewn proximate the border 175 and received through a plurality of loops 191 sewn onto an outside surface 174 of the first segment 171 of the lower fastening strap 170. An end 193 of the strap 190 is adjustably receivable through a male component 205 of the second buckle fastening system 200. Male component 205 is engageable with a female component 210 sewn in spaced relationship to the first component 180 of the hook and eye fastening system on the outside surface 185 of the second segment 173.

In use, the knee pad 100 of the invention may be worn over the knee of a wearer to provide protection to the knee while allowing for mobility and flexibility. The upper fastening strap 150 may be adjustably secured above the knee bend. The lower fastening strap 170 may be adjustably secured below the knee bend by first securing the hook and eye fastening system and then securing the buckle fastening system. The hook and eye fastening system ensures that the lower fastening strap 170 does not release when repeated kneeling and standing occurs or when walking on the knees. The hook and eye fastening system further provides for a tighter fit.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto and their equivalents.

I claim:

1. A knee pad comprising:

a cushion section;

an upper fastening strap including a first buckle fastening system, the upper fastening strap attached to a cushion section upper portion first border and the first buckle fastening system including a female buckle component attached to a cushion section upper portion second border and a male buckle component adjustably received by the upper fastening strap; and a lower fastening strap including a hook and eye fastening system and a second buckle fastening system, the lower fastening strap including a first segment attached to a cushion section lower portion first border and a second segment attached to a cushion section lower portion second border, wherein the hook and eye fastening system comprises a first component formed on an outside surface of, and proximate an end of, the lower fastening strap second segment and a second component formed on an inside surface of, and proximate an end of, the lower fastening strap first segment, and the second buckle fastening system comprises a female buckle component attached to the outside surface of the lower fastening strap second segment in spaced relationship to the hook and eye fastening system first component, a strap attached to a cushion section lower portion first border and receivable through a plurality of loops formed on an outside surface of the lower fastening strap first segment, and a male buckle component, the strap adjustably receivable in the male buckle component.

2. A knee pad comprising:

a cushion section;

an upper fastening strap including a first buckle fastening system, the upper fastening strap attached to a cushion section upper portion second border and the first buckle fastening system having a first female buckle component attached to a cushion section upper portion first border and a first male buckle component adjustably received by the upper fastening strap; and a lower fastening strap including a hook and eye fastening system and a second buckle fastening system, the hook and eye fastening system having a first component formed on an outside surface of, and proximate an end of, a lower fastening strap second segment and a second component formed on an inside surface of, and proximate an end of, a lower fastening strap first segment, and the second buckle fastening system having a second female buckle component attached on the outside surface of the lower fastening strap second segment in spaced relationship to the hook and eye fastening system first component, a second strap attached to a cushion section lower portion first border and receivable through a plurality of loops formed on an outside surface of the lower fastening strap first segment, and a second male buckle component, the strap adjustably receivable in the male buckle component.

* * * * *